US012311216B2

(12) United States Patent
Huth, III et al.

(10) Patent No.: US 12,311,216 B2
(45) Date of Patent: May 27, 2025

(54) TRAINING DEVICE WITH COLLAPSIBLE ARMS

(71) Applicant: Implus Footcare, LLC, Durham, NC (US)

(72) Inventors: Richard Raymond Huth, III, Encinitas, CA (US); Giovanni Erick Guidetti, III, Rancho Santa Margarita, CA (US)

(73) Assignee: IMPLUS FOOTCARE LLC, Durham, NC (US)

( * ) Notice: Subject to any disclaimer, the term of this patent is extended or adjusted under 35 U.S.C. 154(b) by 146 days.

(21) Appl. No.: 18/240,749

(22) Filed: Aug. 31, 2023

(65) Prior Publication Data

US 2024/0066345 A1 Feb. 29, 2024

Related U.S. Application Data

(60) Provisional application No. 63/402,578, filed on Aug. 31, 2022.

(51) Int. Cl.

| | |
|---|---|
| ***A63B 21/055*** | (2006.01) |
| ***A63B 21/00*** | (2006.01) |
| ***A63B 23/16*** | (2006.01) |

(52) U.S. Cl.

CPC ..... *A63B 21/0557* (2013.01); *A63B 21/4035* (2015.10); *A63B 23/16* (2013.01)

(58) Field of Classification Search

CPC . A63B 21/0557; A63B 21/4035; A63B 23/16; A63B 67/06; A63B 67/08; A63B 2022/0092; A63B 2071/0694; A63B 2210/54; A63B 22/00; A63B 21/0004

See application file for complete search history.

(56) References Cited

U.S. PATENT DOCUMENTS

| | | | |
|---|---|---|---|
| 2,187,493 | A | 1/1940 | Gordon |
| 2,361,988 | A | 11/1944 | Bonnifield |
| 3,069,804 | A | 12/1962 | Cirafesi |

(Continued)

FOREIGN PATENT DOCUMENTS

| | | | |
|---|---|---|---|
| DE | 4404692 | A1 | 4/1995 |
| GB | 1290777 | A | 9/1972 |
| WO | 2021113947 | A1 | 6/2021 |

OTHER PUBLICATIONS

PCT/US2023/031680 , "International Search Report and the Written Opinion", Nov. 24, 2023, 11 pages.

*Primary Examiner* — Andrew S Lo

(74) *Attorney, Agent, or Firm* — Kilpatrick Townsend & Stockton LLP

(57) ABSTRACT

A training device including a hub, at least one elastic cord, and at least two arms. The hub including an upper side, a lower side, and a plurality of ports. The at least one elastic cord extending from the hub and is accessible via at least one of the plurality of ports. The at least two arms extending from the hub and are configured to move relative to the hub. The training device is configured to assume (i) a closed state wherein the at least two arms both extend downwardly from the lower side of the hub and (ii) an open state wherein the at least two arms extend laterally outwardly from the hub between the upper side and the lower side of the hub. The at least one elastic cord biases the at least two arms in the open state.

20 Claims, 11 Drawing Sheets

(56) References Cited

U.S. PATENT DOCUMENTS

| | | | | |
|---|---|---|---|---|
| 3,868,115 | A | 2/1975 | Faiferlick | |
| 3,881,729 | A | 5/1975 | Block et al. | |
| 4,216,962 | A | 8/1980 | Flemming | |
| 4,284,278 | A | 8/1981 | Bradford | |
| 4,309,038 | A | 1/1982 | Spoon | |
| 4,452,461 | A | 6/1984 | O'Brien | |
| D287,517 | S | 12/1986 | Larson | |
| 4,817,961 | A | 4/1989 | Stone | |
| 5,180,171 | A | 1/1993 | Panzica et al. | |
| D340,480 | S | 10/1993 | Cummings | |
| 5,413,354 | A | 5/1995 | Miller | |
| 5,655,777 | A | 8/1997 | Neading et al. | |
| 5,868,596 | A | 2/1999 | Perthou | |
| 5,906,529 | A | 5/1999 | Spais | |
| 5,975,982 | A | 11/1999 | Spector | |
| 6,179,738 | B1 | 1/2001 | Perthou | |
| 6,210,278 | B1 | 4/2001 | Klitsner | |
| 6,428,381 | B1 | 8/2002 | Stern | |
| 6,443,861 | B1 | 9/2002 | Foulke | |
| D519,588 | S | 4/2006 | Carbonero | |
| 7,022,036 | B2 | 4/2006 | Duflon et al. | |
| D572,426 | S | 7/2008 | McCollum et al. | |
| 7,731,196 | B2 | 6/2010 | Scoccia | |
| D642,227 | S | 7/2011 | Walterscheid | |
| 8,047,936 | B2 | 11/2011 | Duflon et al. | |
| D677,977 | S | 3/2013 | O'Connell et al. | |
| D700,755 | S | 3/2014 | Reiss et al. | |
| 8,734,276 | B2 | 5/2014 | Laurienzo et al. | |
| D708,817 | S | 7/2014 | Axelrod et al. | |
| D708,818 | S | 7/2014 | Axelrod et al. | |
| D709,561 | S | 7/2014 | Baumann et al. | |
| D709,565 | S | 7/2014 | Baumann et al. | |
| D712,602 | S | 9/2014 | Chen et al. | |
| 8,904,967 | B2 | 12/2014 | Reiss et al. | |
| D721,439 | S | 1/2015 | Swartz | |
| D724,235 | S | 3/2015 | Kuneyl | |
| D729,322 | S | 5/2015 | Fisher | |
| D746,018 | S | 12/2015 | Axelrod et al. | |
| D751,258 | S | 3/2016 | Setser | |
| D755,446 | S | 5/2016 | Hansen | |
| D758,024 | S | 5/2016 | Setser | |
| D779,136 | S | 2/2017 | Eisenbarth | |
| 9,566,520 | B2 | 2/2017 | Naum | |
| D803,327 | S | 11/2017 | Gaus | |
| D819,279 | S | 5/2018 | Gick | |
| 10,226,678 | B1 | 3/2019 | De Schipper et al. | |
| D853,058 | S | 7/2019 | Cox | |
| D870,400 | S | 12/2019 | Toolan et al. | |
| D871,686 | S | 12/2019 | Toolan et al. | |
| 10,610,799 | B2 | 4/2020 | Broeker | |
| D906,437 | S | 12/2020 | Broeker | |
| D930,287 | S | 9/2021 | Toolan et al. | |
| D931,555 | S | 9/2021 | Gong | |
| D931,556 | S | 9/2021 | Gong | |
| D932,114 | S | 9/2021 | Toolan et al. | |
| D936,233 | S | 11/2021 | Lowsky et al. | |
| D936,915 | S | 11/2021 | Gong | |
| D938,052 | S | 12/2021 | Lowsky et al. | |
| D946,835 | S | 3/2022 | Zhang | |
| 11,273,352 | B1 | 3/2022 | Martin | |
| D953,662 | S | 5/2022 | Soto | |
| 11,324,992 | B2 * | 5/2022 | Wu | A63B 1/00 |
| 2001/0029904 | A1 | 10/2001 | Viola | |
| 2001/0031677 | A1 | 10/2001 | Coleman et al. | |
| 2003/0184013 | A1 | 10/2003 | Chodosh | |
| 2005/0288110 | A1 | 12/2005 | Cohen | |
| 2006/0094573 | A1 | 5/2006 | Weck | |
| 2006/0211551 | A1 | 9/2006 | Mandell | |
| 2008/0004166 | A1 * | 1/2008 | Oren | A63B 23/03541 482/142 |
| 2011/0319184 | A1 * | 12/2011 | Young | A63B 69/3623 473/218 |
| 2012/0271345 | A1 | 10/2012 | Torres | |
| 2018/0214755 | A1 | 8/2018 | Villalba | |
| 2018/0271062 | A1 | 9/2018 | Toolan et al. | |
| 2019/0083895 | A1 | 3/2019 | Broeker | |
| 2019/0358514 | A1 | 11/2019 | Kersteman | |
| 2020/0038773 | A1 | 2/2020 | Broeker | |
| 2021/0178237 | A1 | 6/2021 | Pierre et al. | |

* cited by examiner

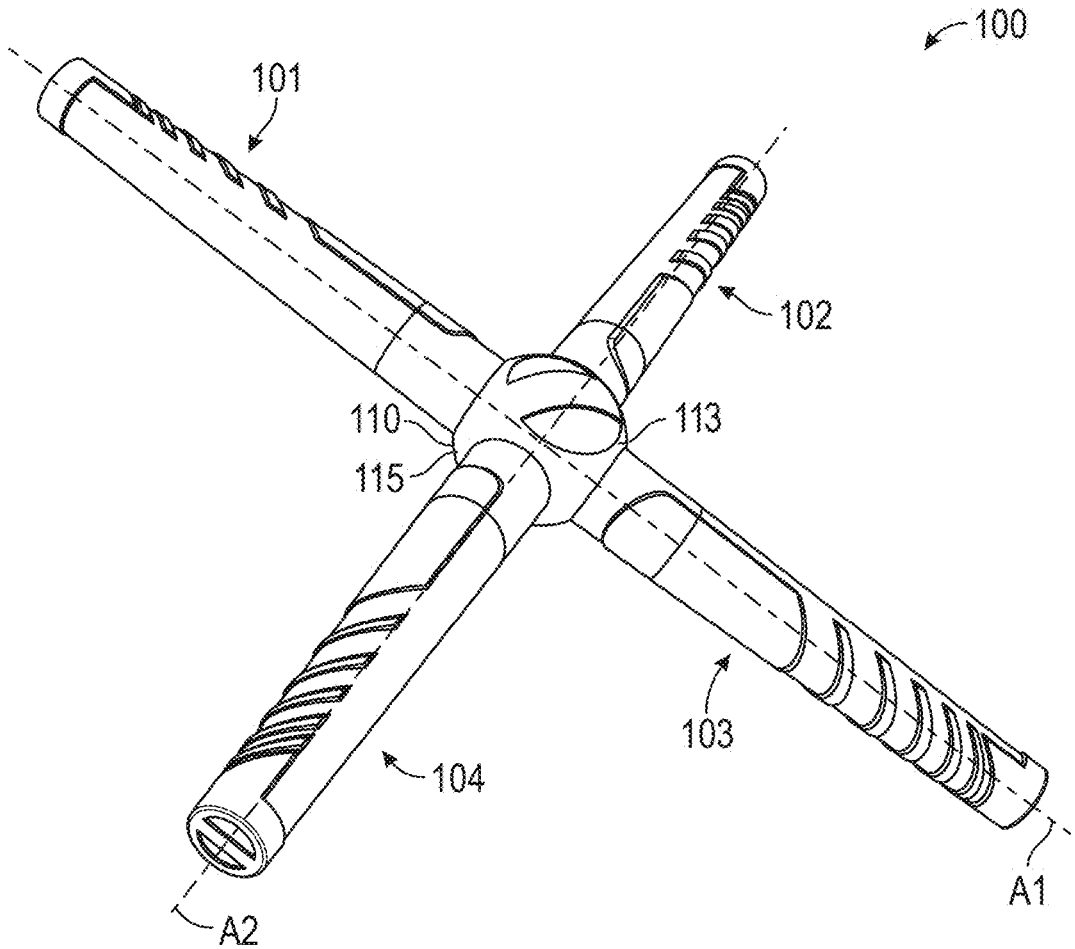
FIG. 1
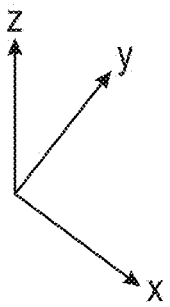

TRAINING DEVICE WITH COLLAPSIBLE ARMS

CROSS-REFERENCE TO RELATED APPLICATION

This application claims the benefit of U.S. Provisional Application No. 63/402,578, filed Aug. 31, 2022, the entirety of which is hereby incorporated by reference.

FIELD OF DISCLOSURE

This disclosure relates generally to a training device that can be used for improving athletic performance of a user.

BACKGROUND

Devices are available for different training exercises, outdoor activities, and other entertainment purposes. Some devices are used for improving skills such as flexibility, agility, etc. to maintain a healthy lifestyle and improve athletic performance. There is always a need for a device that is easy to use and that keeps a group or individual engaged and interested in a particular activity.

BRIEF SUMMARY

The terms "invention," "the invention," "this invention" and "the present invention" used in this patent are intended to refer broadly to all of the subject matter of this patent and the patent claims below. Statements containing these terms should be understood not to limit the subject matter described therein or to limit the meaning or scope of the patent claims below. Embodiments of the invention covered by this patent are defined by the below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Embodiments of the present disclosure provide a training device including: a hub including an upper side, a lower side, and a plurality of ports; at least one elastic cord extending from the hub and accessible via at least one of the plurality of ports; and at least two arms extending from the hub, wherein each of the at least two arms (i) has a proximal end proximate the hub and a distal end distal hub, (ii) extends along an axis from the hub, (iii) is coupled to the at least one elastic cord, and (iv) is configured to move relative to the hub; wherein the training device is configured to assume (i) a closed state wherein the at least two arms both extend downwardly from the lower side of the hub and (ii) an open state wherein the at least two arms extend laterally outwardly from the hub between the upper side and the lower side of the hub and in different directions from the hub, and wherein the at least one elastic cord biases the at least two arms in the open state.

BRIEF DESCRIPTION OF THE DRAWINGS

The disclosure will be readily understood by following the detailed description in conjunction with the accompanying drawings, in which:

FIG. 1 is a top perspective view of an embodiment of a training device in accordance with the present disclosure.

DETAILED DESCRIPTION OF THE DISCLOSURE

Figure 2:
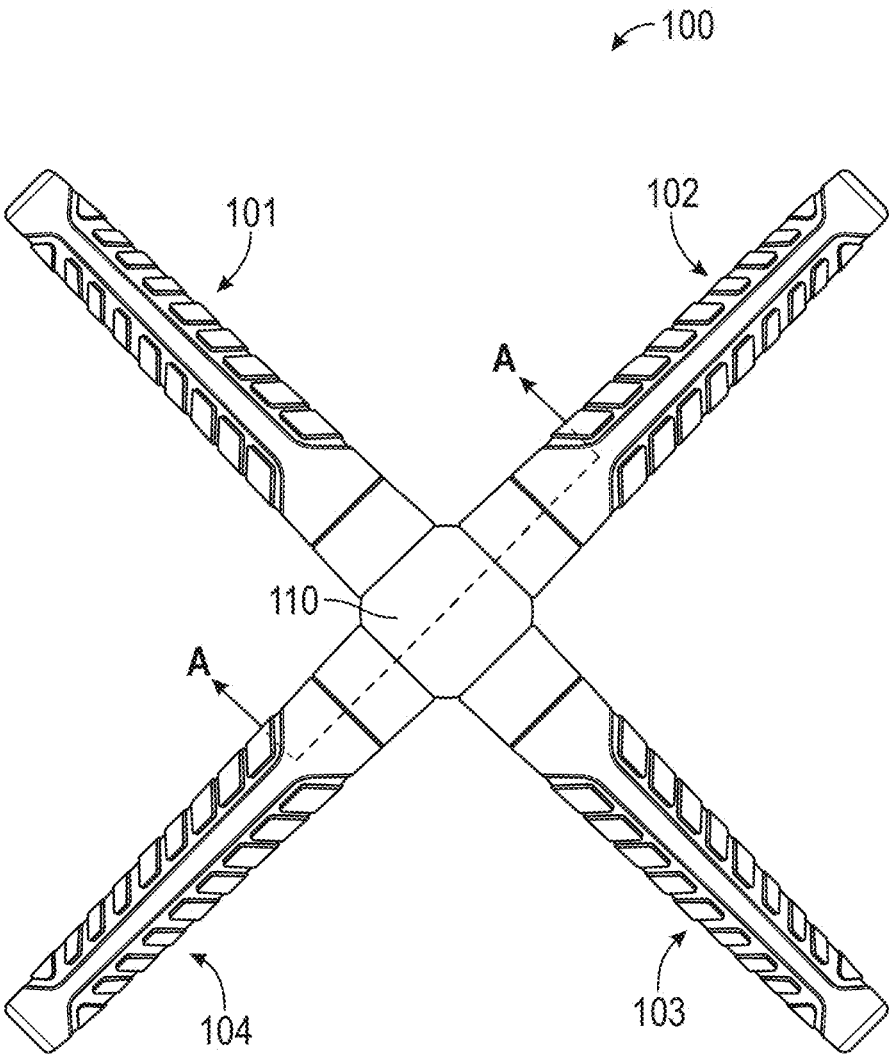
FIG. 2 is a bottom plan view of the training device of FIG. 1.

The subject matter of embodiments of the present invention is described here with specificity to meet statutory requirements, but this description is not intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Each example is provided by way of illustration and/or explanation, and not as a limitation. For instance, features illustrated or described as part of one embodiment may be used on another embodiment to yield a further embodiment. Upon reading and comprehending the present disclosure, one of ordinary skill in the art will readily conceive many equivalents, extensions, and alternatives to the specific, disclosed luminaire types, all of which are within the scope of embodiments herein.

In the following description, positional terms like "above," "below," "vertical," "horizontal," "bottom," "top," and the like are sometimes used to aid in explaining and specifying features illustrated in the drawings as presented, that is, in the orientation which labels of the drawings read normally.

Figure 3:
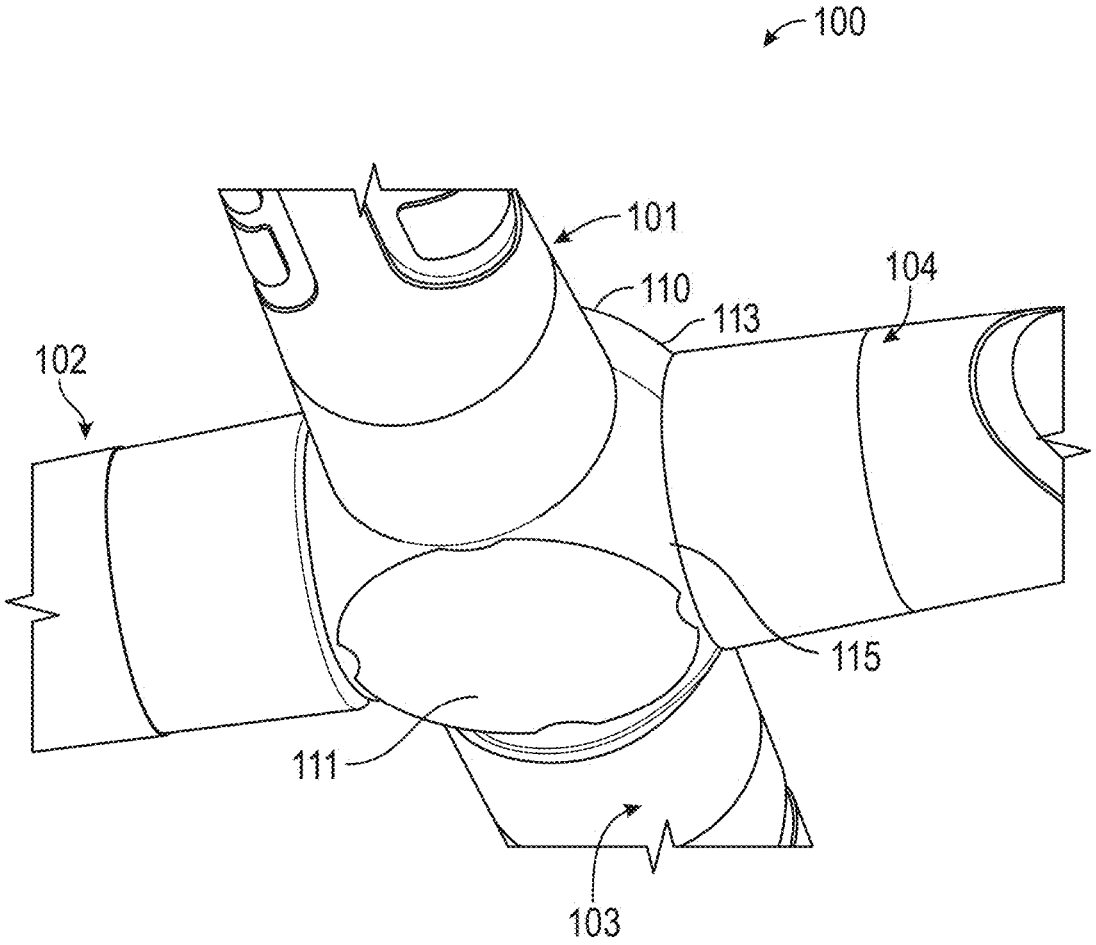
FIG. 3 is an enlarged partial bottom perspective view of the training device of FIG. 1

FIGS. 1-3 illustrate a training device 100 that may be used for cognitive training, according to various embodiments described herein. In the illustrated embodiment, the training device 100 may include a hub 110 and a plurality of arms (e.g., four arms 101, 102, 103, and 104) that may be movably coupled to and extend from the hub 110. In the illustrated embodiment, four arms 101-104 are attached to the hub 110; however, this is merely exemplary and fewer or more arms may be provided.

In some embodiments, the hub 110 may be formed of foam, but it is also envisioned that the hub 110 be formed of other lightweight materials (e.g., polymeric materials) regularly used for the construction and manufacture of sporting goods or exercise equipment.

The hub 110 includes an upper side 113 (above where the arms 101-104 connect to the hub 110) and a lower side 115 (below where the arms 101-104 connect to the hub 110). In some embodiments, the hub 110 may assume a generally or entirely spherical shape. In other embodiments, the hub 110 is only partially spherical and includes a lower surface 111 (see FIG. 3) on the lower side 113 of the hub 110 that is substantially flat. However, the hub 110 may be of any shape (oval, square, triangular, etc.) and varying the geometry of either or both the hub 110 and the lower surface 111 are within the scope of this disclosure. For example, in some embodiments, the hub 110 has an oval, square, triangular, etc. shape and the lower surface 111 may not be flat but instead may be concave or convex.

Figure 5A:
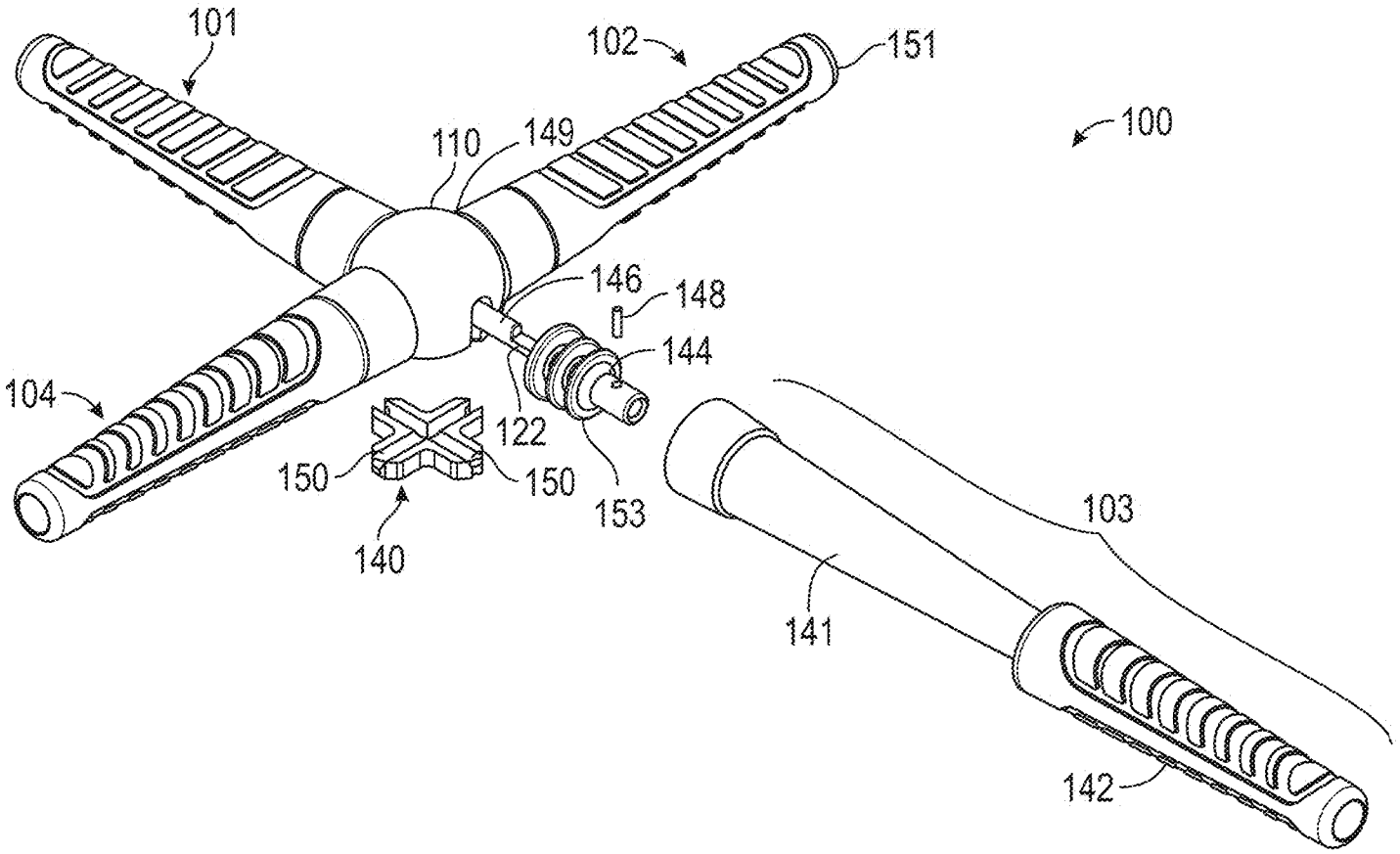
FIG. 5A is a partial exploded view of the training device of FIG. 1.
Figure 5B:
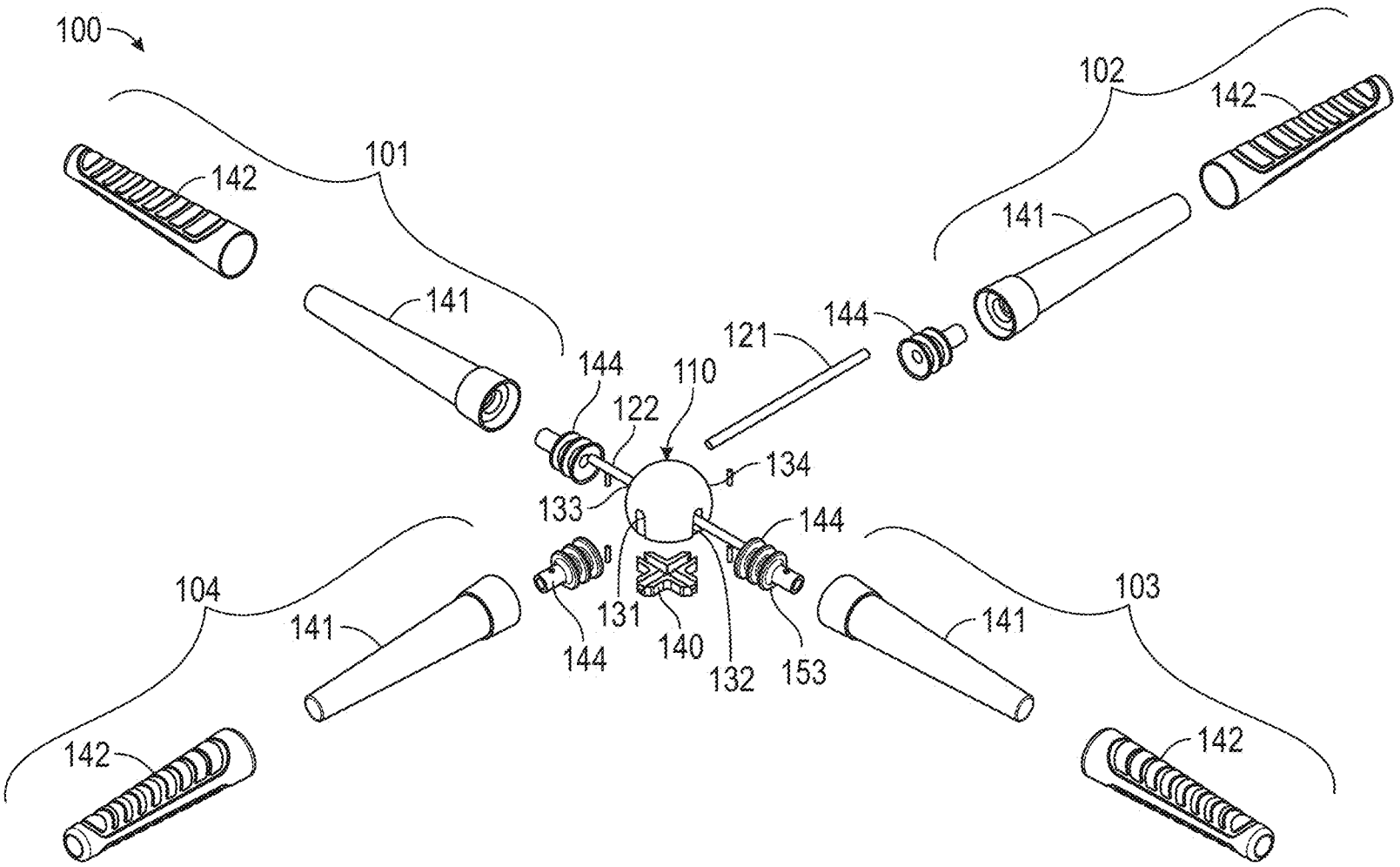
FIG. 5B is an exploded view of the training device of FIG. 1.

With reference to FIGS. 5A-5B, the hub 110 may be configured to house elastic cords 121, 122 that movably couple the arms 101-104 to the hub 110. As shown in FIG. 5B, each elastic cord 121, 122 may be coupled to two of the arms 101-104. For example, elastic cord 121 extends between arm 102 and arm 104, and elastic cord 122 extends between arm 101 and arm 103. Additionally, the hub 110 may include ports 131-134, through which the elastic cords 121 and 122 can extend outwardly from the hub 110 and couple to the arms 101-104. As shown, the ports 131-134 may be aligned with each of the arms such that the elastic cords 121, 122 may extend through the hub 110 colinearly with the arms. In more detail, ports 131 and 134 may be aligned so that elastic cord 121 may pass therethrough and similarly ports 132 and 133 are aligned so that elastic cord 122 may pass therethrough. In some embodiments, the ports 131-134 may be shaped as slots, grooves, or indentions that permit movement of the cords 121, 122 in a direction toward the lower side 115 of the hub 110, while restricting movement of the cords 121, 122 in a direction toward the upper side 113 of the hub 110 and/or laterally. In this way, the ports 131-134 may be configured to limit the extent to which the arms 101-104 can spring back upwardly toward the upper side 113 when released by the user. In some embodiments, the ports 131-134 are in the shape of a slot having a closed end 135 more proximate the upper side 113 of the hub 110 and an open end 137 more proximate the lower side 115 of the hub 110.

In some embodiments, the training device 100 may further include an insert 140 positioned within the hub 110. The insert 140 may include a series of internal channels 150 configured to receive a portion of the elastic cords 121 and 122. In some embodiments, the insert 140 is insert molded into the hub 110. However, the insert 140 may be formed integrally with the hub (resulting in the hub 110 and the insert 140 forming a unitary body) or may be formed separately and subsequently attached to the hub 110.

In some embodiments, each channel 150 is associated with a singular elastic cord 121, 122 such that the elastic cord 121 rests within a first channel on the insert 140 and the elastic cord 122 rests within a second channel on the insert 140. Additionally, in some embodiments, each channel may extend colinearly and/or parallel with the axes of the arms 101-104 with which it is associated. For example, a first channel on the insert 140 may extend colinearly and/or parallel with the axes of the first arm 101 and the third arm 103, while a second channel on the insert 140 may extend colinearly and/or parallel with the axes of the second arm 102 and the fourth arm 104.

In some embodiments, at least one plug 146 may be provided on or within the hub 110 to receive the elastic cords 121, 122 that extend through the ports 131-134. Referring to FIG. 5A, each plug 146 may take the form of a tube (e.g., plastic tube) that imparts support and rigidity to each elastic cord 121, 122. In some embodiments, an individual plug 146 is positioned at each of the ports 131-134. In other embodiments, a plug 146 may extend entirely through the hub 110 to connect opposing ports 131-134.

The arms 101-104 may be formed of any relatively lightweight material and in some embodiments the arms 101-104 are formed of a foam material. However, other lightweight materials are contemplated. The arms 101-104 can be provided with features to distinguish and enhance the visibility of the arms 101-104 as well as enhance the user's ability to grip the arms. For example, the arms 101-104 may be formed of colored materials or color may be imparted to the arms 101-104 after formation. In some embodiments, each arm 101-104 is of a color different from some or all of the other arms 101-104. The surface of the arms 101-104 may be textured for improved gripping, decorative purposes, or visual identification.

Figure 7A:
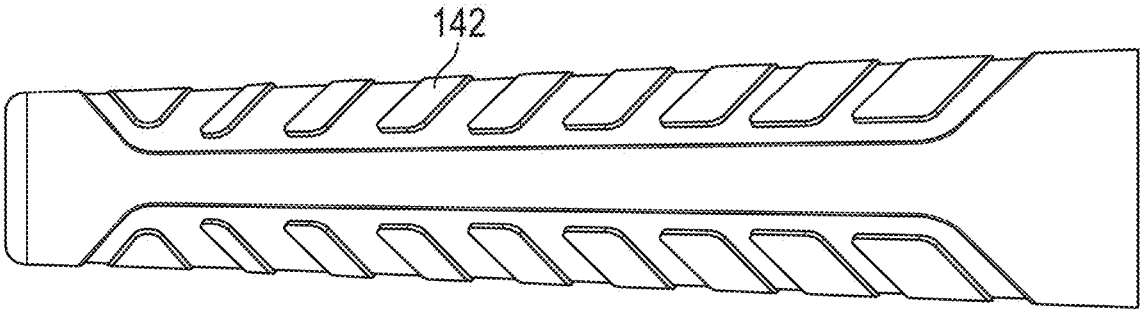
FIG. 7A illustrates one embodiment of an arm in isolation.
Figure 7B:
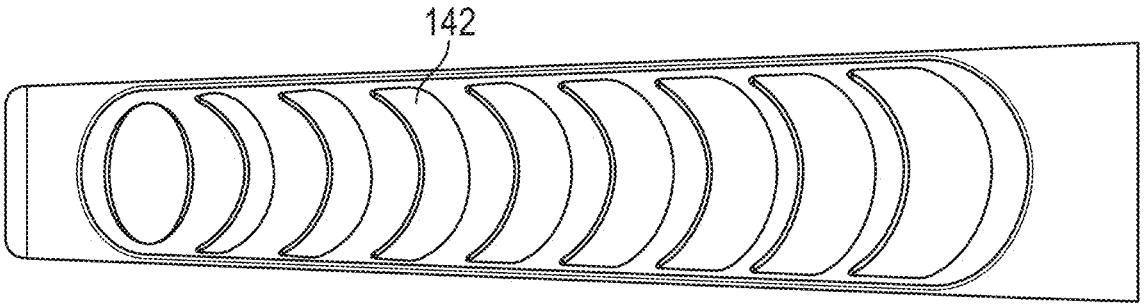
FIG. 7B illustrates another embodiment of an arm in isolation.

In some embodiments, and with reference to FIG. 5B, each of the arms 101-104 may include a handle 141 (e.g., formed of a lightweight material such as foam) and an outer sleeve 142 positioned over each handle 141. In some embodiments, the outer sleeve 142 is formed of silicone, but such is not a requirement. Each outer sleeve 142 may be a different color from all or other of the sleeves 142 such that a user may easily differentiate between each arm 101-104. For example, each outer sleeve 142 may be of a different color (e.g., red, green, yellow, and blue). Color may be imparted to the outer sleeves 142 during or after sleeve formation. Additionally, and/or alternatively, each outer sleeve 142 may be textured for improved gripping (e.g., see FIGS. 7A-7B), decorative purposes, or additional visual identification. In some embodiments, the outer sleeves 142 may be individually removable from each of the handles 141 so they may be cleaned and/or replaced. Each outer sleeve 142 may be designed or configured to match a desired game or activity specification and may be specifically and easily interchanged as to use the same training device 100 in a variety of different ways to enhance athletic performance.

In some embodiments, anchors 144 are used to operably couple the elastic cords 121, 122 to their respective arms 101-104. Each anchor 144 may include a hollow channel configured to receive an end portion of an elastic cord 121, 122. To secure each elastic cord 121, 122 within each anchor 144, a pin 148 may be inserted through a wall of the anchor 144 to engage, secure, or pin the elastic cord 121, 122 to the anchor 144. In this way, the elastic cord 121, 122 may be retained in a tensioned state.

Figure 6:
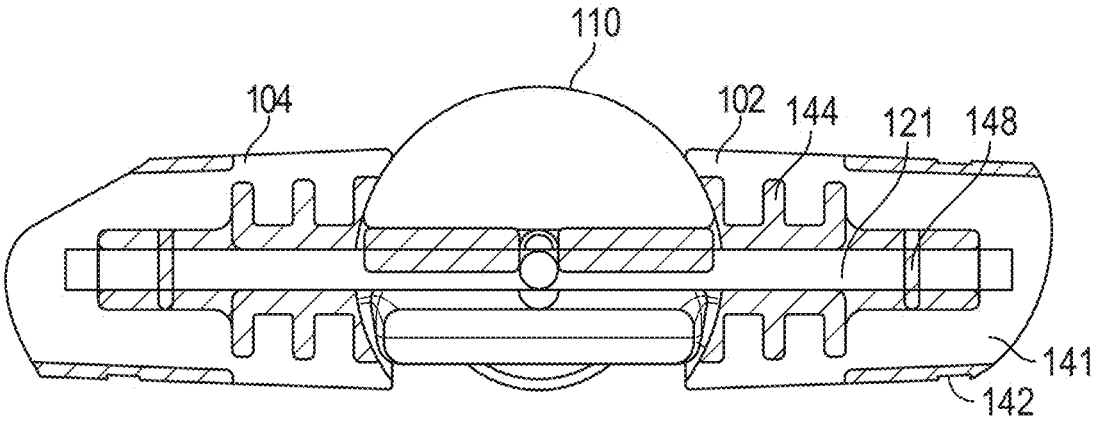
FIG. 6 is a partial cross-section of the training device taken along line A-A in FIG. 2.

As shown in FIG. 6, each anchor 144 may be inserted within a hollow cavity of a respective arm 101-104 to secure the anchor 144 and the arm 101-104 together and thereby operably couple the arms 101-104 to the hub 110. In some embodiments, retention structures 153 may be provided on the outer surface of the anchors 144 to facilitate coupling of the anchors 144 and the arms 101-104. For example, the outer surfaces of the anchors 144 may be threaded, patterned, or textured to help position and/or retain the components together. In some embodiments, the retention structures 153 of the anchor 144 may be sized to press-fit within an arm 101-104. Alternatively, the anchors 144 may be secured to the arms 101-104 using threading, molding, or other methods known in the art. When coupled, each arm 101-104 has a proximal end 149 positioned proximate the hub 110 and a distal end 151 distal the hub 110. Each arm 101-104 extends laterally outwardly from the hub 110 in a different direction.

With the arms 101-104 installed on the anchors 144, the elastic cords 121, 122 are operably coupled to the arms 101-104 to facilitate movement of the arms 101-104 relative to the hub 110. Thus, an anchor 144 establishes a connection between an elastic cord 121, 122 and a respective arm 101-104, such that the arm 101-104 may move relative to the hub 110 while still being coupled to the hub 110. Because the elastic cords 121, 122 are under tension, each arm 101-104 is biased towards the hub 110 which helps retain each arm 101-104 in, as well as return each arm 101-104 to, an equilibrium open state.

In the illustrated embodiments herein, the arms 101-104 of the training device 100 are coupled using the elastic cords 121, 122, however the present disclosure is not limited to such a connection. In an alternative example and in some embodiments, the arms 101-104 may be coupled to the hub 110 via flexible arm connectors integrally formed with the hub 110. For example, the flexible arm connectors may take the form of a cord or cords which are integrated into the hub 110, and subsequently are coupled to each of the arms 101-104. In such cases, the cord may be made of a pliable, elastic, or semi-elastic material such as foam, rubber, and/or plastic, allowing for each of the arms 101-104 to be biased towards the hub 110 without the use of an elastic cord 121, 122. In some additional embodiments, the flexible arm connection may take the form of projections which are integrally formed and extend outwards from the hub 110. Such projections would have a smaller diameter than each arm 101-104 and may be press-fit or form fit to secure each arm 101-104 to the hub 110. Said projections may be made of pliable, elastic, or semi-elastic material as to bias each of the arms 101-104 to the hub 110, encouraging the training device 100 to return to the open state.

Figure 8A:
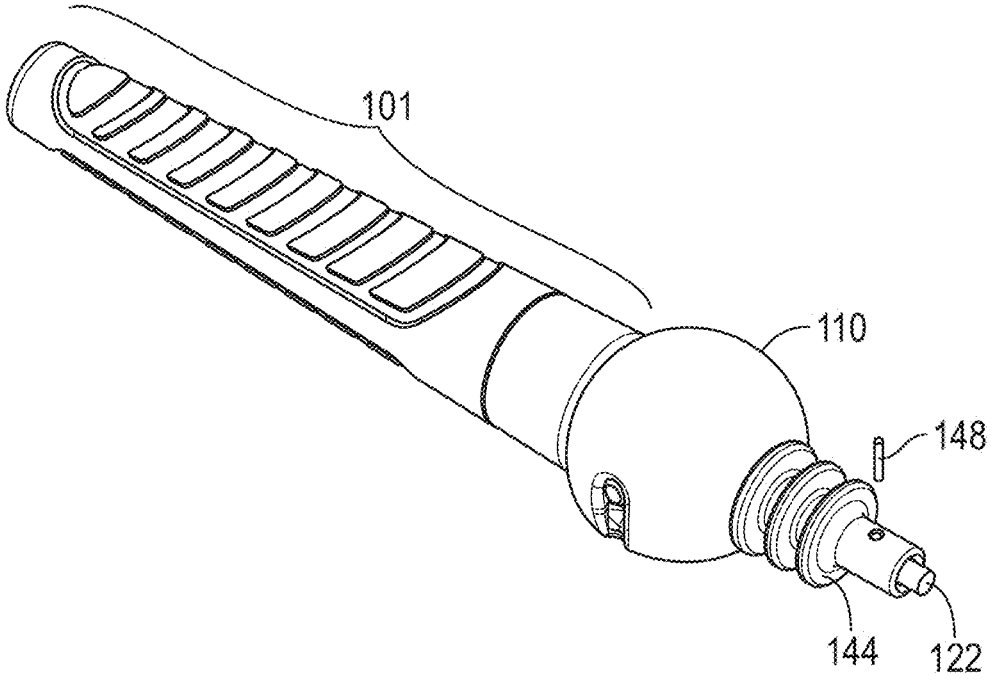
FIGS. 8A-8G illustrate one possible sequence of steps for manufacturing the training device of FIG. 1.
Figure 8B:
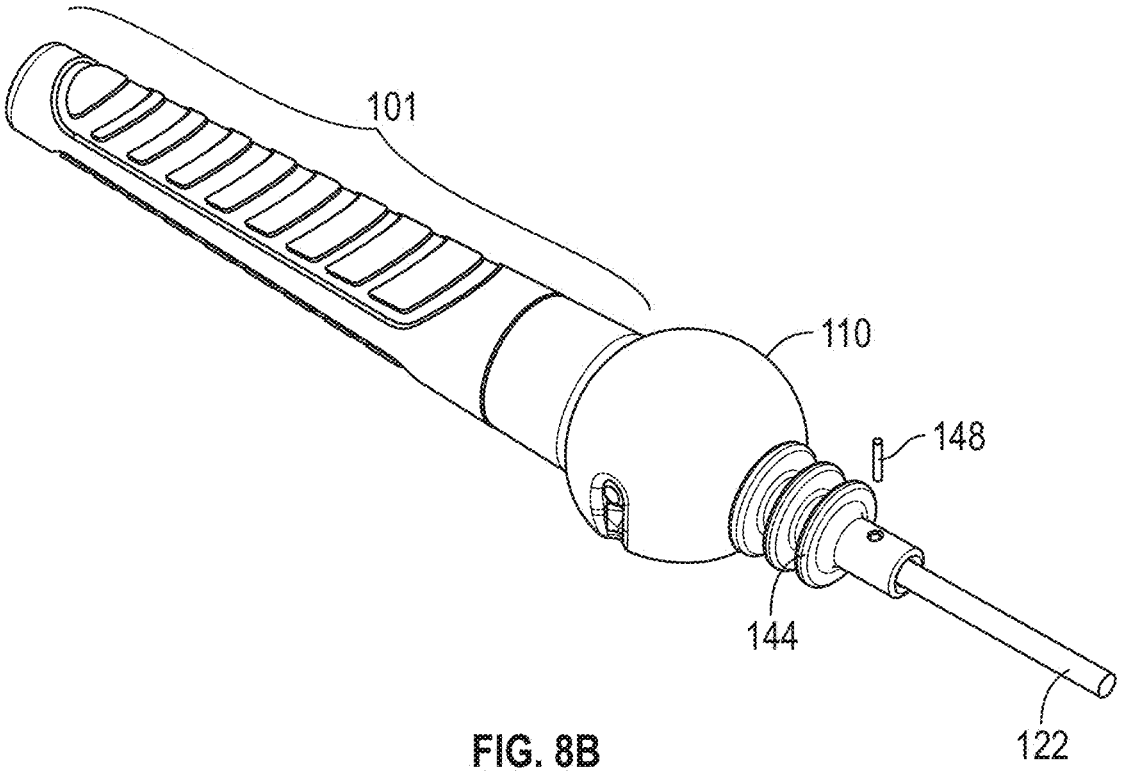
Figure 8C:
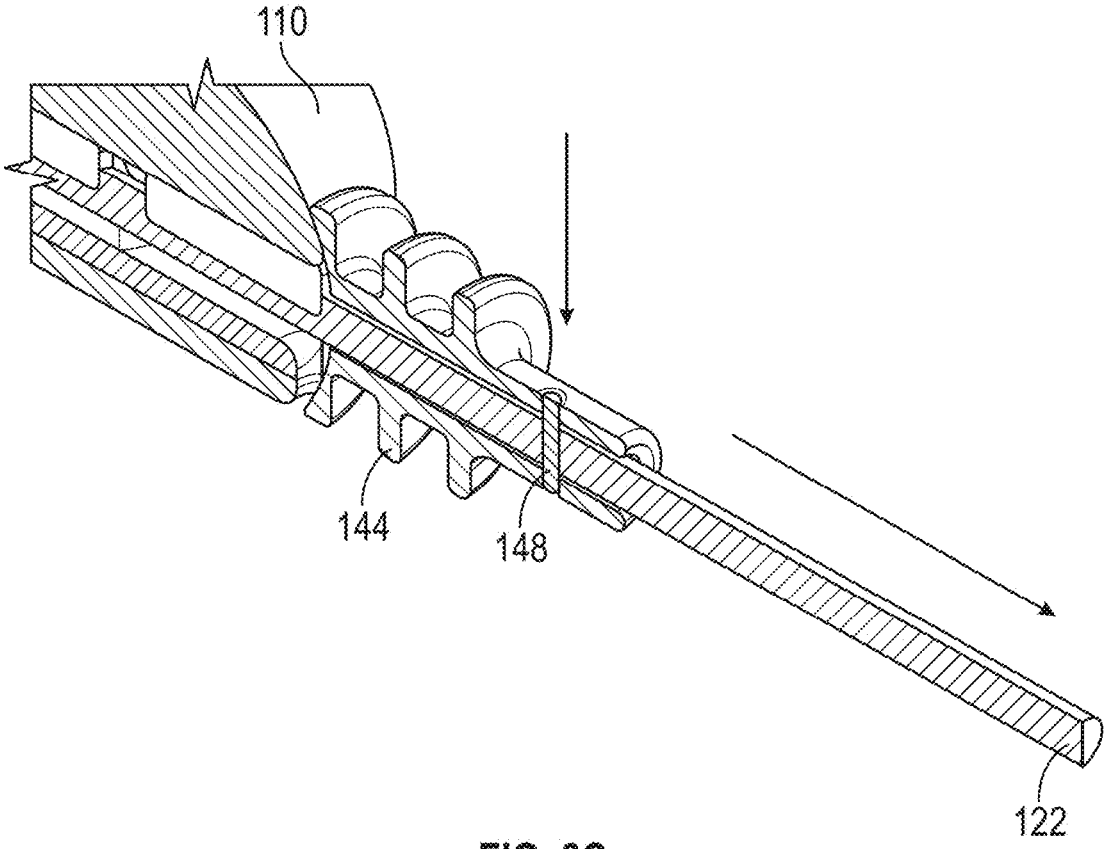
Figure 8D:
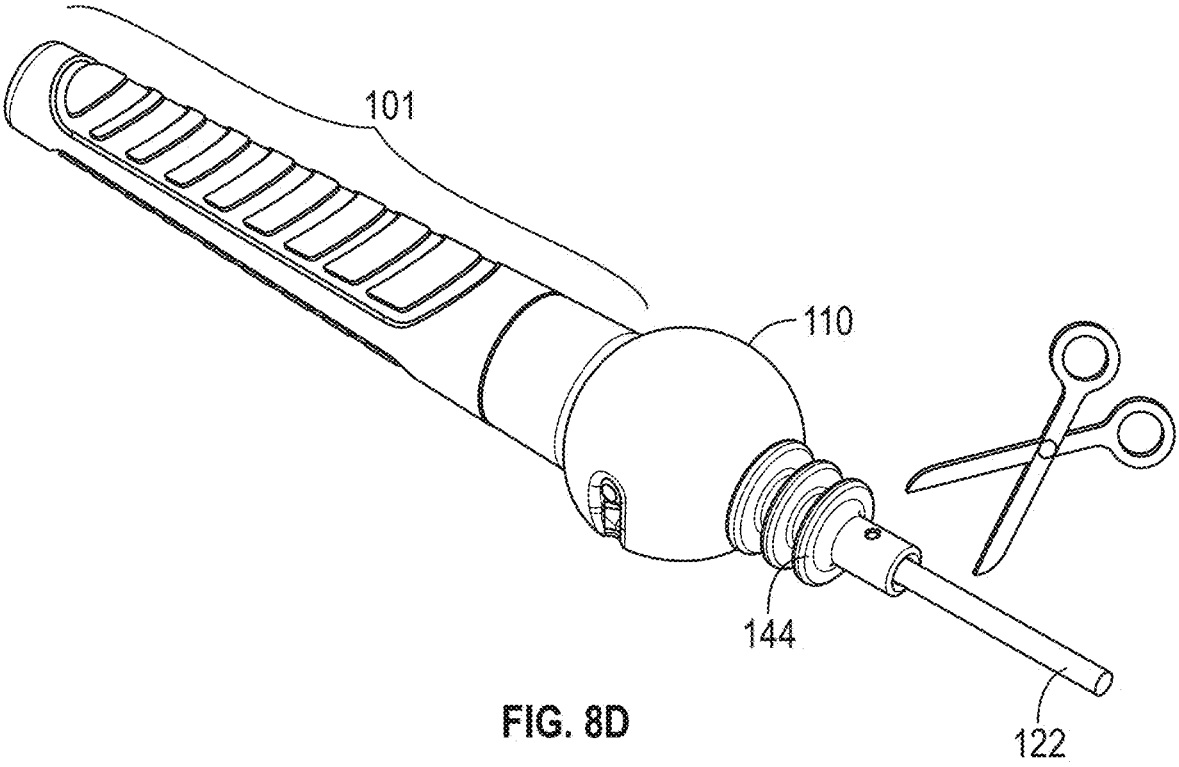

FIGS. 8A-8G depict an exemplary process for manufacturing the training device 100. FIG. 8A depicts a hub 110 which may include a molded foam ball including four ports 131-134 for which elastic cords 121, 122 may be ran through. A singular arm (e.g., 101) is coupled to the hub 110 using an anchor 144 (not shown) to which an elastic cord (e.g., 122) is secured. Opposing the singular arm 101 is an unattached anchor 144. Now referring to FIG. 8B, the elastic cord 122 may be pulled taught or under tension through said unattached anchor 144. As noted previously, a singular elastic cord, in this case cord 122, may be used to coupled two opposing arms (e.g., 101 and 103) to the hub. Once the elastic cord 122 is properly tensioned, and now referring to FIG. 8C, the pin 148 may be inserted through an outer wall of the anchor 144, pinching or piercing the elastic cord 122, and securing the anchor 144 and the elastic cord 122 together to retain the elastic cord 122 in a tensioned state. The tension present in the singular elastic cord 122 biases both the arm 101 and the anchor 144 towards the hub 110. As depicted in FIG. 8D, the excess elastic cord 122 may then be trimmed or cut, to reduce the amount of un-tensioned cord 122.

Figure 8E:
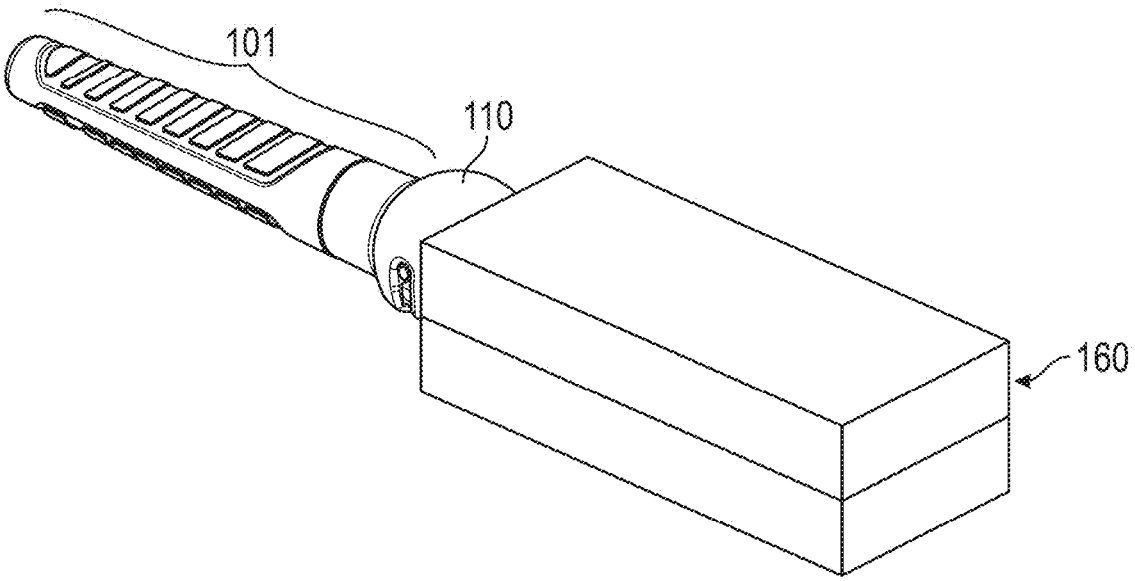

In reference to FIG. 8E, with the anchor 144 secured to the elastic cord 122, a mold 160 may be positioned over the anchor 144. Such a mold 160 may be used to form the second arm 103 using, for example, over-molding, compression molding, injection molding, blow molding, or other molding techniques known in the art. In particular, the mold 160 may be used to form the handle 141 out of foam or other materials typically used in sporting good or exercise equipment. Alternatively, each arm 101-104 may be pre-formed and subsequently mounted on the anchor 144.

Figure 8F:
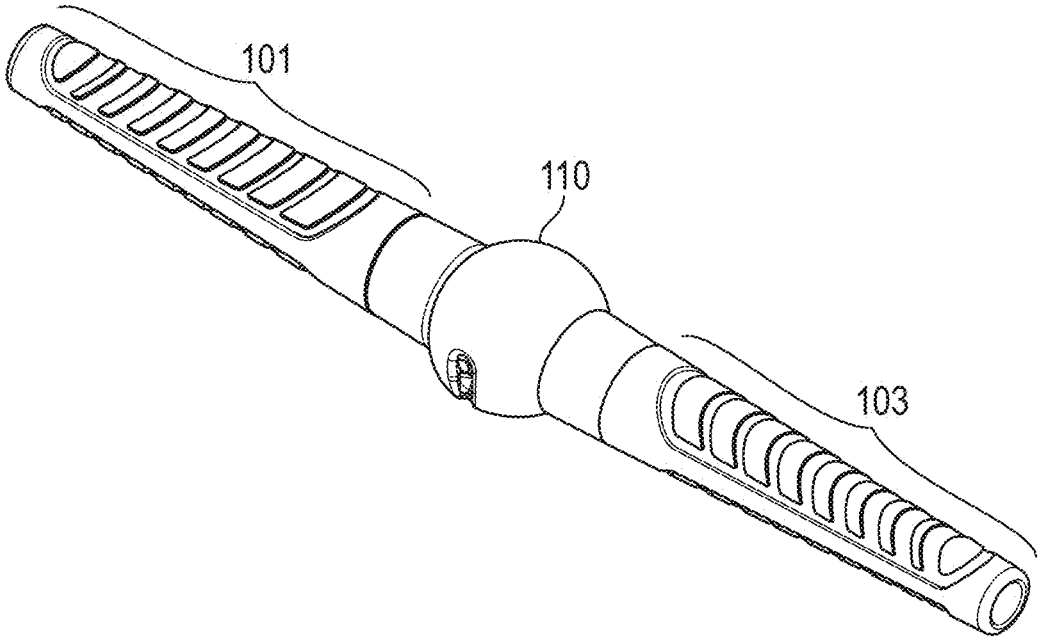
Figure 8G:
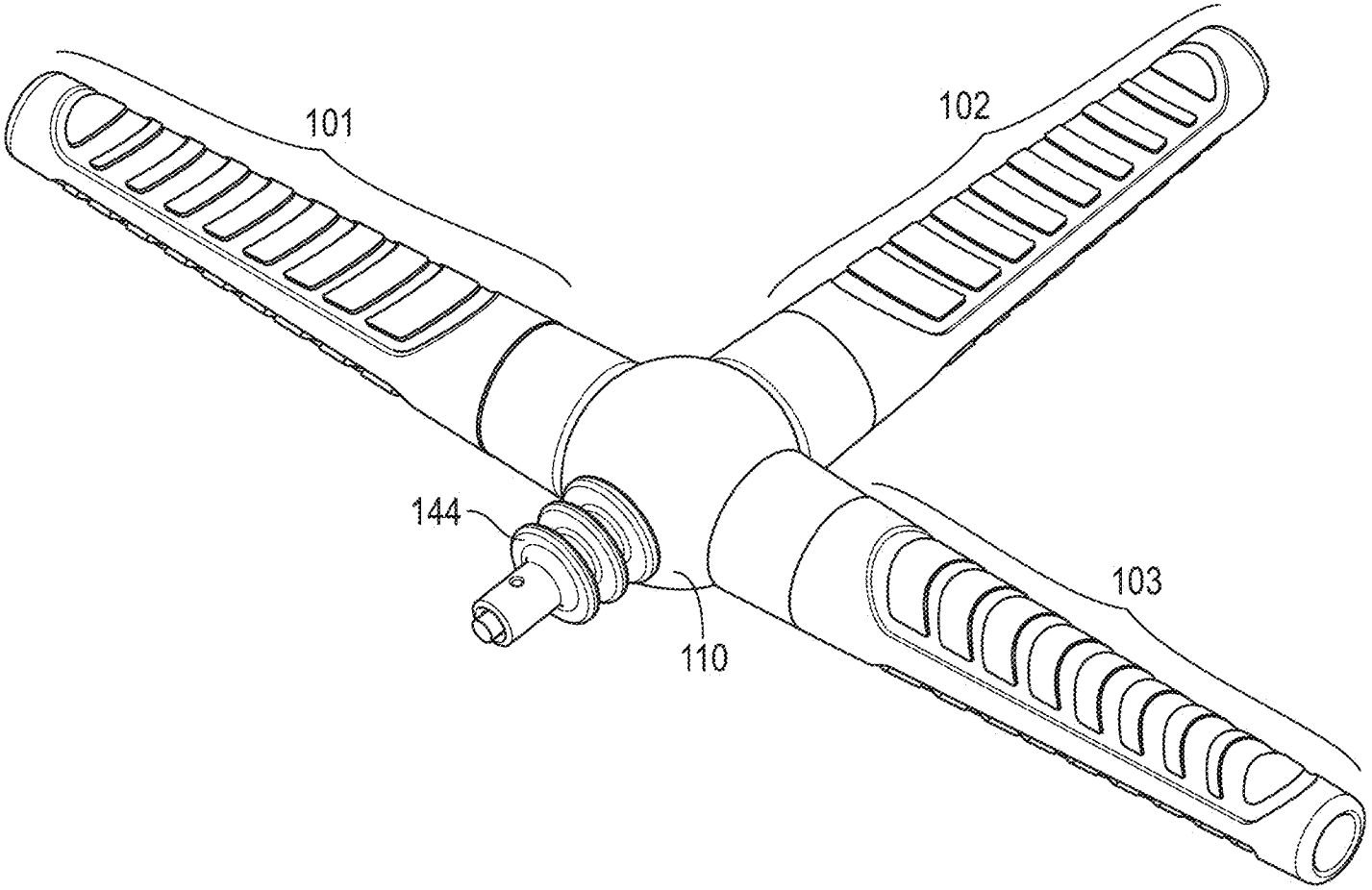

Once the handle 141 is molded, and now referring to FIG. 8F, an outer sleeve 142 may be positioned onto the handle 141. As noted previously, the outer sleeve 142 may include various colors, textures, or other identifying or aesthetic details that may be tailored to a specific use of the of the training device 100. To finish the remaining arms 102, 104, the process described in relation to FIGS. 8A-8F may be repeated. For example, a third arm is depicted in FIG. 8G.

The manufacturing process of the training device 100 described herein and in FIGS. 8A-8G is merely exemplary and is not intended to be limiting. Various alternative manufacturing methods, including the addition or subtraction of steps, or the reordering of various steps are envisioned within the scope of this disclosure and would be appreciate by one skilled in the art.

The arms 101-104 can assume an open state and a closed state. In the open (equilibrium) state and as illustrated in FIG. 1, the arms 101-104 may extend outwardly from the hub 110 in different directions. In some embodiments, each arm 101-104 may be positioned colinearly with the respective ports 131-134 on the hub 110 from which the elastic cords 121, 122 extend. As depicted in FIG. 1, arm 101 and arm 103 extend colinearly along a first axis A1 (although laterally outwardly in different directions from the hub 110), and arm 102 and arm 104 extend colinearly along a second axis A2 (although laterally outwardly in different directions from the hub 110). In the illustrated example, the first axis A1 is perpendicular to the second axis A2, allowing the training device 100 to form an approximately cross shape in the open state. It can be understood that arms extended along two axes A1 and A2 is only exemplar. In some embodiments, each of the four arms may extend along different axes or be non-linear with respect to each other. Moreover, while the arms 101-104 are shown extending substantially coplanar in the open state, such is not a requirement.

Figure 4:
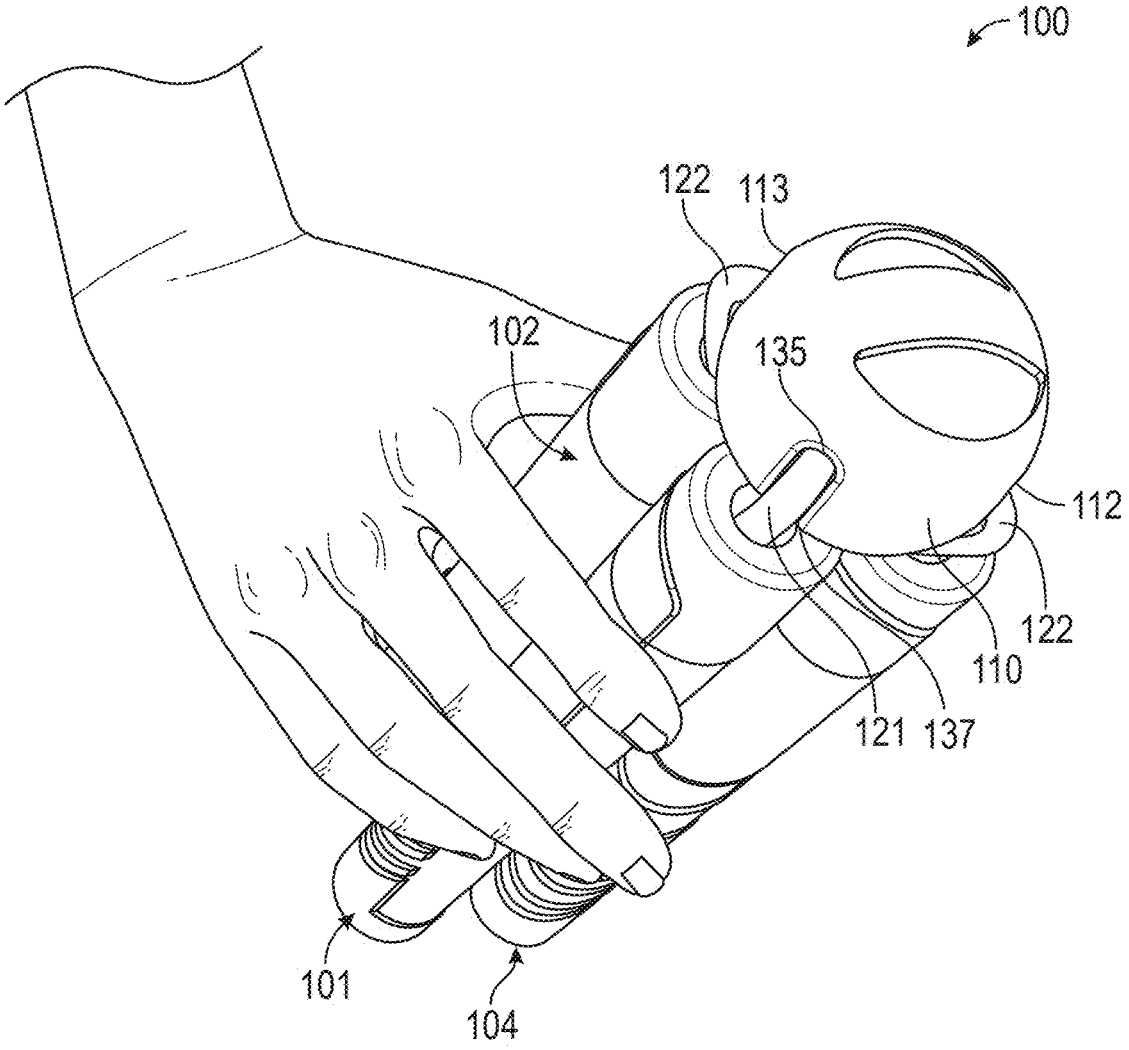
FIG. 4 is a perspective view of the training device in a closed state in accordance with the present disclosure.

In the closed state and as illustrated in FIG. 4, each of the arms 101-104 may be bent generally downwardly under tension toward the lower side 115 of the hub 110 such that they collapse against each other and their proximal ends 149 are positioned adjacent to the lower surface 111 of the hub 110. In some embodiments, the arms 101-104 may extend substantially parallel to each other when in the closed state. When in the closed state, all four arms 101-104 of the training device 100 may be gripped in a single hand of a user such that all four arms 101-104 are squeezed together, causing the elastic cords 121 and 122 to be under tension. It is envisioned that a user may be able to throw the training device 100 when in the closed state using only a single hand. Because the arms are under tension, when released each arm 101-104 springs in a direction toward the upper side 113 of the hub 110 to return to its equilibrium state. In some embodiments, their upward movement is limited by ports 131-134. Furthermore, each of the arms 101-104 may be tensioned or closed independently from one another, such that a user may selectively hold each individual arm 101-104 in either the closed state or the open state simultaneously. In some embodiments, the arms 101-104 are angled relative to the hub 110. For example, the arms 101-104 may be angled or biased in a direction toward the lower side 115 of the hub 110 to facilitate easily drawing of the arms 101-104 close to each other to assume the closed state.

In one exemplary use, the described training device 100 may be used for cognitive or reaction-based training. For example, a first user may hold the device 100 in a closed state. The first user may then toss the device 100 towards a second user and, while the device 100 is airborne, the first user may call out a color associated with one of the arms 101-104. Once released by the first user, the device 100 may transition from the closed state to the open state due to the tension of the elastic cords 121, 122. The second user will then be challenged to catch the device 100 by the arm 101-104 that is associated with the color that the first user calls out. Such a task will challenge the second user's reaction time, hand-eye coordination, and overall dexterity. Once caught, the second user may repeat the process and throw the device 100 back towards the first user, allowing for both users to improve their cognitive and reaction-based skills. This use is merely one exemplary use and other uses of the device 100 are appreciated within the scope of this disclosure. For example, a singular user may toss the device 100 in the air and catch the device 100 themselves to test and train their cognitive and reaction-based skills without the need for a second user. Similarly, the device 100 may be used by a group of users. Additionally, and as noted previously, the arms 101-104 may be configured to include various textures, colors, and other aesthetic properties, to allow for the device 100 to be interchangeably used in different applications or uses other than those described herein.

The various aspects, embodiments, implementations, or features of the described embodiments can be used separately or in any combination. In particular, it should be appreciated that the various elements of concepts from FIGS. 1— 8G may be combined without departing from the spirit or scope of the invention.

A collection of exemplary embodiments, including at least some explicitly enumerated as "Examples" providing additional description of a variety of example types in accordance with the concepts described herein are provided below. These examples are not meant to be mutually exclusive, exhaustive, or restrictive; and the invention is not limited to these examples but rather encompasses all possible modifications and variations within the scope of the issued claims and their equivalents.

Example 1. A training device including: a hub including an upper side, a lower side, and a plurality of ports; at least one elastic cord extending from the hub and accessible via at least one of the plurality of ports; and at least two arms extending from the hub, wherein each of the at least two arms (i) has a proximal end proximate the hub and a distal end distal hub, (ii) extends along an axis from the hub, (iii) is coupled to the at least one elastic cord, and (iv) is configured to move relative to the hub; wherein the training device is configured to assume (i) a closed state wherein the at least two arms both extend downwardly from the lower side of the hub and (ii) an open state wherein the at least two arms extend laterally outwardly from the hub between the upper side and the lower side of the hub and in different directions from the hub, and wherein the at least one elastic cord biases the at least two arms in the open state.

Example 2. The training device of any of the preceding or subsequent examples or combination of examples, wherein the at least two arms include a first arm and a second arm and wherein, in the open state, the axis of the first arm and the axis of the second arm are substantially colinear.

Example 3. The training device of any of the preceding or subsequent examples or combination of examples, wherein in the closed state, the axis of the first arm and the axis of the second arm are substantially parallel but not substantially colinear.

Example 4. The training device of any of the preceding or subsequent examples or combination of examples, wherein the hub further includes at least one internal channel in which the at least one elastic cord extends and wherein, in the open state, the at least one internal channel extends substantially parallel to the axis of at least one of the at least two arms.

Example 5. The training device of any of the preceding or subsequent examples or combination of examples, wherein, in the closed state, the at least one internal channel extends substantially perpendicular to the axis of the at least one of the at least two arms.

Example 6. The training device of any of the preceding or subsequent examples or combination of examples, wherein the at least two arms include a first arm, a second arm, a third arm, and a fourth arm.

Example 7. The training device of any of the preceding or subsequent examples or combination of examples, wherein the axis of the first arm and the axis of the third arm are substantially colinear, and the axis of the second arm and the axis of the fourth arm are substantially colinear.

Example 8. The training device of any of the preceding or subsequent examples or combination of examples, wherein the at least one elastic cord includes a first elastic cord and a second elastic cord, wherein the first elastic cord is coupled to the first arm and the third arm, and the second elastic cord is coupled to the second arm and the fourth arm.

Example 9. The training device of any of the preceding or subsequent examples or combination of examples, wherein the hub further includes a first internal channel in which the first elastic cord extends and a second internal channel in which the second elastic cord extends and wherein, when the training device is in the open state, the first internal channel extends substantially parallel to the axis of the first arm and the axis of the third arm and the second internal channel extends substantially parallel to the axis of the second arm and the axis of the fourth arm.

Example 10. The training device of any of the preceding or subsequent examples or combination of examples, wherein each of the at least two arms includes a handle and an outer sleeve removably positioned on the handle.

Example 11. The training device of any of the preceding or subsequent examples or combination of examples, wherein the handle includes foam and the outer sleeve includes silicone.

Example 12. The training device of any of the preceding or subsequent examples or combination of examples, wherein a first of the at least two arms is physically differentiated from a second of the at least two arms by shape, size, color, and/or texture.

Example 13. The training device of any of the preceding or subsequent examples or combination of examples, wherein the lower side of the hub includes a substantially flat surface and wherein the proximal end of each of the at least two arms is positioned proximate the substantially flat surface when the training device is in the closed state.

Example 14. The training device of any of the preceding or subsequent examples or combination of examples, wherein the at least one elastic cord is configured to be under tension when in the closed state to bias the at least two arms toward the open state.

Example 15. The training device of any of the preceding or subsequent examples or combination of examples, further including an anchor coupled to one the at least two arms, wherein the anchor includes a hollow channel configured to receive and secure the at least one elastic cord in a tensioned state.

Example 16. The training device of any of the preceding or subsequent examples or combination of examples, wherein the anchor is configured to be received within the one of the at least two arms and includes at least one retention structure positioned on an outer surface of the anchor to couple the at least one anchor to the one of the at least two arms.

Example 17. A training device comprising: a hub comprising an upper side, a lower side, and a plurality of ports; a plurality of elastic cords extending from the hub and accessible via at least one of the plurality of ports; and a plurality of arms extending from the hub, wherein each of the plurality of arms (i) has a proximal end proximate the hub and a distal end distal hub, (ii) extends along an axis from the hub, (iii) is coupled to one of the plurality of elastic cords, and (iv) is configured to move relative to the hub, wherein the training device is configured to assume (i) a closed state wherein the plurality of arms extends downwardly from the lower side of the hub and (ii) an open state wherein the plurality of arms extends laterally outwardly from the hub between the upper side and the lower side of the hub and in different directions from the hub, wherein the plurality of elastic cords bias the plurality of arms in the open state, wherein the plurality of arms comprises a first arm, a second arm, a third arm, and a fourth arm, wherein, in the open state, the axis of the first arm and the axis of the third arm are substantially colinear and the axis of the second arm and the axis of the fourth arm are substantially colinear, wherein, in the closed state, the first arm, the second arm, the third arm, and the fourth arm extend from the hub such that the axis of each of the first arm, the second arm, the third arm, and the fourth arm are substantially parallel but not substantially colinear, and wherein the plurality of elastic cords comprises a first elastic cord and a second elastic cord, wherein the first elastic cord is coupled to the first arm and the third arm, and the second elastic cord is coupled to the second arm and the fourth arm.

Example 18. The training device of any of the preceding or subsequent examples or combination of examples, wherein the hub further includes a first internal channel in which the first elastic cord extends and a second internal channel in which the second elastic cord extends and wherein, when the training device is in the open state, the first internal channel extends substantially parallel to the axis of the first arm and the axis of the third arm and the second internal channel extends substantially parallel to the axis of the second arm and the axis of the fourth arm.

Example 19. The training device of any of the preceding or subsequent examples or combination of examples, wherein each of the plurality of arms includes a handle and an outer sleeve removably positioned on the handle.

Example 20. The training device of any of the preceding or subsequent examples or combination of examples, wherein each of the first arm, the second arm, the third arm, and the fourth arm are of a different color.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, or gradients thereof, unless otherwise indicated herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

As used herein, the term "substantially" refers to the complete or nearly complete extent or degree of an action, characteristic, property, state, structure, item, or results. For example, an object that is "substantially" enclosed would mean that the object is either completely enclosed or nearly completely enclosed. The exact allowable degree of deviation from absolute completeness may in some cases depend on the specific context. However, generally speaking, the nearness of completion will be so as to have the same overall results as if absolute and total completion were obtained.

Preferred embodiments of this invention are described herein, including the best mode known to the inventors for carrying out the invention. The invention is susceptible to various modifications and alternative constructions, and certain shown exemplary embodiments there are shown in the drawings and have been described above in detail. Variations of those preferred embodiments, within the spirit of the present invention, may become apparent to those of ordinary skill in the art upon reading the foregoing description. The inventors expect skilled artisans to employ such variations as appropriate, and the inventors intend for the invention to be practiced otherwise than as specifically described herein. Accordingly, it should be understood that there is no intention to limit the invention to the specific form or forms disclosed, but on the contrary, this invention includes all modifications and equivalents of the subject matter recited in the claim appended hereto as permitted by applicable law. Moreover, any combination of the above-described elements in all possible variations thereof is encompassed by the invention unless otherwise indicated herein or otherwise clearly contradicted by context. The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

It is to be understood that terms such as "distal," "proximal," "side," "inner," and the like that can be used herein merely describe points of reference and do not necessarily limit embodiments of the present disclosure to any particular orientation or configuration. As used herein, "proximal" refers to a direction toward the end of the female contact stack near the clinician and "distal" refers to a direction away from the clinician and (generally) inside the body of a patient. Furthermore, terms such as "first," "second," "third," etc., merely identify one of a number of portions, components, steps, operations, functions, and/or points of reference as disclosed herein, and likewise do not necessarily limit embodiments of the present disclosure to any particular configuration or orientation.

The terms "longitudinal," "axial" or "axially" are generally longitudinal as used herein to describe the relative position related to a female contact stack or other components of the system herein. For example, "longitudinal" or "axial" indicates an axis passing along a center of a female contact stack from a proximal end to a distal end. The term "radial" generally refers to a direction perpendicular to the "axial" direction.

Disjunctive language such as the phrase "at least one of X, Y, or Z," unless specifically stated otherwise, is intended to be understood within the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

While certain embodiments have been described, these embodiments have been presented by way of example only, and are not intended to limit the scope of the present disclosures. Indeed, the novel methods, apparatuses and systems described herein can be embodied in a variety of other forms; furthermore, various omissions, substitutions and changes in the form of the methods, apparatuses and systems described herein can be made without departing from the spirit of the present disclosures.

What is claimed is:

1. A training device comprising:

a hub comprising an upper side, a lower side, and a plurality of ports;

at least one elastic cord extending from the hub and accessible via at least one of the plurality of ports; and at least two arms extending from the hub, wherein each of the at least two arms (i) has a proximal end proximate the hub and a distal end distal the hub, (ii) extends along an axis from the hub, (iii) is coupled to the at least one elastic cord, and (iv) is configured to move relative to the hub, wherein the training device is configured to assume (i) a closed state wherein the at least two arms both extend downwardly from the lower side of the hub and (ii) an open state wherein the at least two arms extend laterally outwardly from the hub between the upper side and the lower side of the hub and in different directions from the hub, and wherein the at least one elastic cord biases the at least two arms in the open state.

2. The training device of claim 1, wherein the at least two arms comprise a first arm and a second arm and wherein, in the open state, the axis of the first arm and the axis of the second arm are substantially colinear.

3. The training device of claim 2, wherein, in the closed state, the axis of the first arm and the axis of the second arm are substantially parallel but not substantially colinear.

4. The training device of claim 1, wherein the hub further comprises at least one internal channel in which the at least one elastic cord extends and wherein, in the open state, the at least one internal channel extends substantially parallel to the axis of at least one of the at least two arms.

5. The training device of claim 4, wherein, in the closed state, the at least one internal channel extends substantially perpendicular to the axis of the at least one of the at least two arms.

6. The training device of claim 1, wherein the at least two arms comprise a first arm, a second arm, a third arm, and a fourth arm.

7. The training device of claim 6, wherein the axis of the first arm and the axis of the third arm are substantially colinear, and the axis of the second arm and the axis of the fourth arm are substantially colinear.

8. The training device of claim 6, wherein the at least one elastic cord comprises a first elastic cord and a second elastic cord, wherein the first elastic cord is coupled to the first arm and the third arm, and the second elastic cord is coupled to the second arm and the fourth arm.

9. The training device of claim 8, wherein the hub further comprises a first internal channel in which the first elastic cord extends and a second internal channel in which the second elastic cord extends and wherein, when the training device is in the open state, the first internal channel extends substantially parallel to the axis of the first arm and the axis of the third arm and the second internal channel extends substantially parallel to the axis of the second arm and the axis of the fourth arm.

10. The training device of claim 1, wherein each of the at least two arms comprises a handle and an outer sleeve removably positioned on the handle.

11. The training device of claim 10, wherein the handle comprises foam and the outer sleeve comprises silicone.

12. The training device of claim 1, wherein a first of the at least two arms is physically differentiated from a second of the at least two arms by shape, size, color, and/or texture.

13. The training device of claim 1, wherein the lower side of the hub comprises a substantially flat surface and wherein the proximal end of each of the at least two arms is positioned proximate the substantially flat surface when the training device is in the closed state.

14. The training device of claim 1, wherein the at least one elastic cord is configured to be under tension when in the closed state to bias the at least two arms toward the open state.

15. The training device of claim 1, further comprising an anchor coupled to one of the at least two arms, wherein the anchor includes a hollow channel configured to receive and secure the at least one elastic cord in a tensioned state.

16. The training device of claim 15, wherein the anchor is configured to be received within the one of the at least two arms and includes at least one retention structure positioned on an outer surface of the anchor to couple the anchor to the one of the at least two arms.

17. A training device comprising:

a hub comprising an upper side, a lower side, and a plurality of ports;

a plurality of elastic cords extending from the hub and accessible via at least one of the plurality of ports; and a plurality of arms extending from the hub, wherein each of the plurality of arms (i) has a proximal end proximate the hub and a distal end distal the hub, (ii) extends along an axis from the hub, (iii) is coupled to one of the plurality of elastic cords, and (iv) is configured to move relative to the hub, wherein the training device is configured to assume (i) a closed state wherein the plurality of arms extends downwardly from the lower side of the hub and (ii) an open state wherein the plurality of arms extends laterally outwardly from the hub between the upper side and the lower side of the hub and in different directions from the hub, wherein the plurality of elastic cords bias the plurality of arms in the open state, wherein the plurality of arms comprises a first arm, a second arm, a third arm, and a fourth arm, wherein, in the open state, the axis of the first arm and the axis of the third arm are substantially colinear and the axis of the second arm and the axis of the fourth arm are substantially colinear, wherein, in the closed state, the first arm, the second arm, the third arm, and the fourth arm extend from the hub such that the axis of each of the first arm, the second arm, the third arm, and the fourth arm are substantially parallel but not substantially colinear, and wherein the plurality of elastic cords comprises a first elastic cord and a second elastic cord, wherein the first elastic cord is coupled to the first arm and the third arm, and the second elastic cord is coupled to the second arm and the fourth arm.

18. The training device of claim 17, wherein hub further comprises a first internal channel in which the first elastic cord extends and a second internal channel in which the second elastic cord extends and wherein, when the training device is in the open state, the first internal channel extends substantially parallel to the axis of the first arm and the axis of the third arm and the second internal channel extends substantially parallel to the axis of the second arm and the axis of the fourth arm.

19. The training device of claim 17, wherein each of the plurality of arms comprises a handle and an outer sleeve removably positioned on the handle.

20. The training device of claim 17, wherein each of the first arm, the second arm, the third arm, and the fourth arm are of a different color.

* * * * *